US005474658A

United States Patent [19]

Scharbert et al.

[11] Patent Number: 5,474,658

[45] Date of Patent: Dec. 12, 1995

[54] ELECTROCHEMICAL PROCESS FOR PREPARING GLYOXYLIC ACID

[75] Inventors: Bernd Scharbert, Frankfurt am Main; Steffen Dapperheld, Hofheim/Ts. both of Germany; Pierre Babusiaux, Lillebonne, France

[73] Assignee: Hoechst AG, Frankfurt, Germany

[21] Appl. No.: 290,951

[22] PCT Filed: Feb. 2, 1993

[86] PCT No.: PCT/EP93/00232

§ 371 Date: Oct. 24, 1994

§ 102(e) Date: Oct. 24, 1994

[87] PCT Pub. No.: WO93/17151

PCT Pub. Date: Sep. 2, 1993

[30] Foreign Application Priority Data

| | | | |
|---|---|---|---|
| Feb. 22, 1992 | [DE] | Germany | 42 05 423.0 |
| May 26, 1992 | [DE] | Germany | 42 17 336.1 |

[51] Int. Cl.[6] ..... C25B 3/04

[52] U.S. Cl. ..... 204/73 R

[58] Field of Search ..... 204/59 R, 72, 204/73 R

[56] References Cited

U.S. PATENT DOCUMENTS

| | | | |
|---|---|---|---|
| 4,560,450 | 12/1985 | Morduchowitz et al. | 204/75 |
| 4,619,743 | 10/1986 | Cook | 204/77 |
| 4,692,226 | 9/1987 | Gimenz et al. | 204/73 R |
| 4,707,226 | 11/1987 | Dapperheld | 204/81 |
| 4,800,012 | 1/1989 | Dapperheld et al. | 204/73 R |

FOREIGN PATENT DOCUMENTS

| | | |
|---|---|---|
| 9179652 | 1/1992 | Australia . |
| 0241685 | 10/1987 | European Pat. Off. . |
| 0280120 | 8/1988 | European Pat. Off. . |
| 2587039 | 3/1987 | France . |
| 1411371 | 10/1975 | United Kingdom . |
| WO91/19832 | 12/1991 | WIPO . |
| 9119832 | 12/1991 | WIPO . |

OTHER PUBLICATIONS

Scott, A Preliminary Investigation of the Simultaneous Anodic and Cathodic Production of Glyoxylic Acid, Electrochimica Acta, 36(9), 1991 (no month), pp. 1447–1452.

Goodridge, F. et al, *J. of Appl. Electrochemistry* 10:55–60 (1980) (no month).

Scott, K., *Electrochimica Acta* 36:1477–1452 (1991) (no month).

*Primary Examiner*—Kathryn Gorgos
*Assistant Examiner*—Edna Wong
*Attorney, Agent, or Firm*—Connolly & Hutz

[57] ABSTRACT

The present invention describes a process for preparing glyoxylic acid by electrochemical reduction of oxalic acid in aqueous solution in divided or undivided electrolytic cells, wherein the cathode comprises carbon or at least 50% by weight of at least one of the metals Cu, Ti, Zr, V, Nb, Ta, Fe, Co, Ni, Zn, Al, Sn and Cr and the aqueous electrolysis solution in the undivided cells or in the cathode compartment of the divided cells in addition contains at least one salt of metals having a hydrogen overpotential of at least 0.25 V, based on a current density of 2500 A/m$^2$. The process according to the invention has the advantage that inexpensive materials available on an industrial scale, in particular stainless chromium-nickel steels or graphite can be employed as the cathode material.

21 Claims, No Drawings

ELECTROCHEMICAL PROCESS FOR PREPARING GLYOXYLIC ACID

The present invention relates to a process for preparing glyoxylic acid by electrochemical reduction of oxalic acid.

Glyoxylic acid is an important intermediate in the preparation of industrially relevant compounds and can be prepared either by controlled oxidation of glyoxal or by electrochemical reduction of oxalic acid.

The electrochemical reduction of oxalic acid to give glyoxylic acid has been known for a long time and is generally carried out in an aqueous, acidic medium, at low temperature, on electrodes having a high hydrogen overpotential, for example on electrodes made of lead, cadmium or mercury, with or without the addition of mineral acids and in the presence of an ion exchanger membrane (German Published Application 163 842, 292 866, 458 438).

The conventional electrolytic processes used hitherto involving oxalic acid on an industrial scale, or experiments with prolonged electrolysis did not give satisfactory results, since the current yield fell off significantly as the electrolysis progressed (German Published Application 347 605) and the generation of hydrogen increased.

To overcome these drawbacks, the reduction of oxalic acid was carried out on lead cathodes in the presence of additives, for example tertiary amines or quaternary ammonium salts (German Laid Open Applications 22 40 759, 23 59 863). The concentration of the additive in these cases is between $10^{-5}$% and 1%. This additive is then contained in the glyoxylic acid product and must be removed by a separation process. The documents mentioned do not provide any detailed information on the selectivity of the process.

In Goodridge etal., J. Appl. Electrochem., 10, 1 (1980), pp. 55–60, various electrode materials are studied with regard to their current yield in the electrochemical reduction of oxalic acid. It was found in this study that a hyperpure lead cathode (99.999%) is most suitable for this purpose, while a graphite cathode results in a distinctly lower current yield.

International Patent Application WO-91/19832 likewise describes an electrochemical process for preparing glyoxylic acid from oxalic acid, in which process, however, hyperpure lead cathodes having a purity of more than 99.97% are used in the presence of small amounts of lead salts dissolved in the electrolysis solution. In this process, the lead cathodes are periodically rinsed with nitric acid, as a result of which the service life of the cathodes is reduced. A further drawback of this process consists in the oxalic acid concentration having to be constantly maintained in the saturation concentration range during the electrolysis. The selectivity in this case is only 95%.

Hitherto, only the use of graphite cathodes and cathodes having a high hydrogen overvoltage, such as lead, mercury or cadmium and alloys of these metals has been described. With respect to industrial application of the said process, these materials have grave drawbacks regarding toxicity and use and workability in an electrochemical cell.

The object of the present invention is to provide a process for the electrochemical reduction of oxalic acid to give glyoxylic acid, which avoids the drawbacks mentioned above, which, in particular, has a high selectivity, achieves as low as possible an oxalic acid concentration at the end of the electrolysis and uses a cathode having good long-term stability. At the same time, the cathode is to be composed of an industrially readily available or easily worked material. Selectivity is understood as the ratio of the amount of glyoxylic acid produced to the amount of all the products formed during the electrolysis, namely glyoxylic acid plus by-products, for example glycolic acid, acetic acid and formic acid.

The object is achieved in that the electrochemical reduction of oxalic acid is carried out on cathodes which comprise carbon or at least 50% by weight of at least one of the metals Cu, Ti, Zr, V, Nb, Ta, Fe, Co, Ni, Zn, Al, Sn and Cr, and the electrolyte is composed of, or contains, salts of metals having a hydrogen overpotential of at least 0.25 V at a current density of 2500 A/m$^2$.

The subject of the present invention is therefore a process for preparing glyoxylic acid by electrochemical reduction of oxalic acid in aqueous solution in divided or undivided electrolytic cells, wherein the cathode comprises carbon or at least 50% by weight of at least one of the metals Cu, Ti, Zr, V, Nb, Ta, Fe, Co, Ni, Zn, Al, Sn and Cr and the aqueous electrolysis solution in the undivided cells or in the cathode compartment of the divided cells in addition contains at least one salt of metals having a hydrogen overpotential of at least 0.25 V, preferably at least 0.40 V based on a current density of 2500 A/m$^2$.

All those materials are suitable as the cathode for the process according to the invention, which comprise at least 50% by weight, preferably at least 80% by weight, especially at least 93% by weight, of one or more of the metals Cu, Ti, Zr, V, Nb, Ta, Fe, Co, Ni, Zn, Al, Sn and Cr, preferably Fe, Co, Ni, Cr, Cu and Ti, or alternatively any carbon electrode materials, for example electrode graphite, impregnated graphite materials, carbon felts, as well as glassy carbon. Alternatively, the abovementioned metallic materials may be alloys of two or more of the abovementioned metals, preferably Fe, Co, Ni, Cr, Cu and Ti. Of particular interest are cathodes comprising at least 80% by weight, preferably from 93 to 96% by weight, of an alloy of two or more of the abovementioned metals and from 0 to 20% by weight, preferably from 4 to 7% by weight, of any other metal, preferably Mn, Ti, Mo or a combination thereof, and from 0 to 3% by weight, preferably from 0 to 1.2% by weight, of a nonmetal, preferably C, Si, P, S or a combination thereof.

The advantage of using the cathode materials according to the invention is that industrially available, inexpensive or easily worked materials can be employed. Particular preference is given to alloy steel or graphite.

For example, stainless chromium-nickel steels having the Material Numbers (according to DIN 17 440) 1.4301, 1.4305, 1.4306, 1.4310, 1.4401, 1.4404, 1.4435, 1.4541, 1.4550, 1.4571, 1.4580, 1.4583, 1.4828, 1.4841 and 1.4845, whose compositions in percent by weight are given in the following table. Preference is given to the alloy steels having the Material Numbers 1.4541 with 17–19% of Cr, from 9 to 12% of Ni, ≦2% of Mn, ≦0.8% of Ti and ≦1.2% of nonmetal fraction (C, Si, P, S) and the Material No. 1.4571, with 16.5–8.5% of Cr, 11–14% of Ni, 2.0–2.5% of Mo, ≦2% of Mn, ≦0.8% of Ti and ≦1.2% of nonmetal fraction (C, Si, P, S).

| Material No. | Code name | % C | % Si | % Mn | % P | % S | % Cr | % Mo | % Ni | others |
|---|---|---|---|---|---|---|---|---|---|---|
| 1.4301 | X5CrNi18 9 | ≦0.07 | ≦1.0 | ≦2.0 | ≦0.045 | ≦0.030 | 17.0–19.0 | — | 8.5–11.0 | |
| 1.4305 | X12CrNiSi18 8 | ≦0.12 | ≦1.0 | ≦2.0 | ≦0.060 | 0.15–0.35 | 17.0–19.0 | ≦0.7 | 8.0–10.0 | |
| 1.4306 | X2CrNi18 9 | ≦0.03 | ≦1.0 | ≦2.0 | ≦0.045 | ≦0.03 | 18.0–20.0 | — | 10.0–12.5 | |
| | G-X2CrNi18 9 | ≦0.03 | ≦1.5 | ≦1.5 | ≦0.045 | ≦0.03 | 17.0–20.0 | — | 9.0–12.0 | |
| 1.4310 | X12CrNi17 7 | 0.08–0.14 | ≦1.5 | ≦2.0 | ≦0.045 | ≦0.03 | 16.0–18.0 | ≦0.8 | 6.5–9.0 | |
| 1.4401 | X5CrNiMo18 10 | ≦0.07 | ≦1.0 | ≦2.0 | ≦0.045 | ≦0.03 | 16.5–18.5 | 2.0–2.5 | 10.5–13.5 | |
| 1.4404 | X2CrNiMo18 10 | ≦0.03 | ≦1.0 | ≦2.0 | ≦0.045 | ≦0.03 | 16.5–18.5 | 2.0–2.5 | 11.0–14.0 | |
| | G-X2CrNiMo18 10 | ≦0.03 | ≦1.5 | ≦1.5 | ≦0.045 | ≦0.03 | 17.0–20.0 | 2.0–3.0 | 10.0–13.0 | |
| 1.4435 | X2CrNiMo18 12 | ≦0.03 | ≦1.0 | ≦2.0 | ≦0.045 | ≦0.03 | 16.5–18.5 | 2.5–3.0 | 12.5–15.0 | |
| 1.4541 | X10CrNiTi18 9 | ≦0.08 | ≦1.0 | ≦2.0 | ≦0.045 | ≦0.03 | 17.0–19.0 | — | 9.0–12.0 | ≦0.8 Ti |
| 1.4550 | X10CrNiNb18 9 | ≦0.08 | ≦1.0 | ≦2.0 | ≦0.045 | ≦0.03 | 17.0–19.0 | — | 9.0–12.0 | <1.0 Nb |
| 1.4571 | X10CrNiMoTi18 10 | ≦0.08 | ≦1.0 | ≦2.0 | ≦0.045 | ≦0.03 | 16.5–18.5 | 2.0–2.5 | 11.0–14.0 | Ti ≧ 0.4% |
| 1.4580 | X10CrNiMoNb18 10 | ≦0.08 | ≦1.0 | ≦2.0 | ≦0.045 | ≦0.03 | 16.5–18.5 | 2.0–2.5 | 11.0–14.0 | Nb ≧ 0.64% |
| 1.4583 | X10CrNiMoNb18 12 | ≦0.10 | ≦1.0 | ≦2.0 | ≦0.045 | ≦0.03 | 16.5–18.5 | 2.5–3.0 | 12.0–14.5 | Nb ≧ 0.8% |
| 1.4828 | X15CrNiSi20 12 | ≦0.20 | 1.5–2.5 | ≦2.0 | ≦0.045 | ≦0.03 | 19.0–21.0 | — | 11.0–13.0 | |
| 1.4841 | X15CrNiSi25 20 | ≦0.20 | 2.5–2.5 | ≦2.0 | ≦0.045 | ≦0.03 | 24.0–26.0 | — | 19.0–22.0 | |
| 1.4845 | X12CrNi25 21 | ≦0.15 | ≦0.75 | ≦2.0 | ≦0.045 | ≦0.03 | 24.0–26.0 | — | 19.0–22.0 | |

The remainder is iron in all cases.

The process according to the invention is carried out in undivided or preferably in divided cells. The division of the cells into anode compartment and cathode compartment is achieved by using the conventional diaphragms which are stable in the aqueous electrolysis solution and which comprise polymers or other organic or inorganic materials, such as, for example, glass or ceramic. Preferably, ion exchanger membranes are used, especially cation exchanger membranes comprising polymers, preferably polymers having carboxyl and/or sulfonic acid groups. It is also possible to use stable anion exchanger membranes.

The electrolysis can be carried out in all conventional electrolytic cells, such as, for example, in beaker cells or plate-and-frame cells or cells comprising fixed-bed or fluid-bed electrodes. Both monopolar and bipolar connection of the electrodes can be employed.

The electrolysis can be carried out both continuously and discontinuously.

Possible anode materials are all those materials which sustain the corresponding anode reactions. For example, lead, lead dioxide on lead or other supports, platinum, metal oxides on titanium, for example titanium dioxide doped with noble metal oxides such as platinum oxide on titanium, are suitable for generating oxygen from dilute sulfuric acid. Carbon, or titanium dioxide doped with noble metal oxides on titanium, are used, for example, for generating chlorine from aqueous alkali metal chloride solutions.

Possible anolyte liquids are aqueous mineral acids or solutions of their salts such as, for example, dilute sulfuric or phosphoric acid, dilute or concentrated hydrochloric acid, sodium sulfate solutions or sodium chloride solutions.

The aqueous electrolysis solution in the undivided cell or in the cathode compartment of the divided cell contains the oxalic acid to be electrolyzed in a concentration which is expediently between approximately 0.1 mol of oxalic acid per liter of solution and the saturation concentration of oxalic acid in the aqueous electrolysis solution at the electrolysis temperature used.

Admixed to the aqueous electrolysis solution in the undivided cell or in the cathode compartment of the divided cell are salts of metals having a hydrogen overpotential of at least 0.25 V (based on a current density of 2500 A/m$^2$). Salts of this type which are suitable in the main are the salts of Cu, Ag, Au, Zn, Cd, Fe, Hg, Sn, Pb, Tl, Ti, Zr, Bi, V, Ta, Cr, Ce, Co or Ni, preferably the salts of Pb, Sn, Bi, Zn, Cd or Cr, especially preferably the salts of Pb. The preferred anions of these salts are chloride, sulfate, nitrate or acetate.

The salts can be added directly or, for example by the addition of oxides, carbonates or in some cases the metals themselves, can be generated in the solution.

The salt concentration of the aqueous electrolysis solution in the undivided cell or in the cathode compartment of the divided cell is expediently set to from $10^{-7}$ to 10% by weight, preferably to from $10^{6}$ to 0.1% by weight, especially from $10^{-5}$ to 0.04% by weight, based in each case on the total amount of the aqueous electrolysis solution. In the case of the carbon cathode, a salt concentration of from $10^{-6}$ to 10% by weight, preferably from $10^{-5}$ to $10^{-1}$% by weight, especially from $10^{-4}$ to $4\times10^{-2}$% by weight, is expedient.

It was found, surprisingly, that even those metal salts can be used which, after addition to the aqueous electrolysis solution, form sparingly soluble metal oxalates, for example the oxalates of Cu, Ag, Au, Zn, Cd, Sn, Pb, Ti, Zr, V, Ta, Ce and Co. Thus the added metal ions can be removed from the product solution in a very simple manner, down to the saturation concentration, by filtration after the electrolysis.

The addition of the said salts can be dispensed with if the abovementioned metal ions in the abovementioned concentration ranges are present at the start of the electrolysis in the aqueous electrolyte solution of the undivided cell or in the cathode compartment of the divided cell. It should be noted that the added metal ions must be present to an amount above 20% by weight as a metallic alloy component in the cathode material. In this case, the addition of the said salts in the abovementioned concentration ranges is necessary.

The presence of the abovementioned metal ions in the abovementioned concentration ranges at the start of the electrolysis is always to be expected, even without the addition of the salts, if after operation has been interrupted, for example after an experiment in the discontinuous mode of operation, a new experiment is started with fresh catholyte liquid, without the cathode being changed. In the case of a prolonged interruption, the cathode may be kept under a protective current and the catholyte may be kept under inert gas.

At the start of an electrolysis, from $10^{-7}$ to 10% by weight, preferably from $10^{-5}$ to 0.1% by weight of mineral acid such as phosphoric acid, hydrochloric acid, sulfuric acid or nitric acid, or organic acids, for example trifluoroacetic acid, formic acid or acetic acid may be added to the catholyte liquid.

The current density of the process according to the invention is expediently between 10 and 10,000 A/m$^2$, preferably between 100 and 5000 A/m$^2$ in the case of a carbon cathode between 10 and 5000 A/m$^2$, preferably between 100 and 4000 A/m$^2$.

The cell voltage of the process according to the invention depends on the current density and is expediently between 1 V and 20 V, preferably between 1 V and 10 V, based on an electrode gap of 3 mm.

The electrolysis temperature can be in the range from −20° C. to +40° C. It was found, surprisingly, that at electrolysis temperatures below +18° C., even for oxalic acid concentrations below 1.5% by weight, the formation of glycolic acid as a by-product may be below 1.5 mol % compared to the glyoxylic acid formed. At higher temperatures, the proportion of glycolic acid increases. The electrolysis temperature is therefore preferably between +10° C. and +30° C., especially between +10° C. and +18° C.

The catholyte flow rate of the process according to the invention is between 1 and 10,000, preferably 50 and 2000, especially 100 and 1000, liters per hour.

The product solution is worked up by conventional methods. If the mode of operation is discontinuous, the electrochemical reduction is halted when a particular degree of conversion has been reached. The glyoxylic acid formed is separated from any oxalic acid still present according to the prior art previously mentioned. For example, the oxalic acid can be fixed selectively on ion exchanger resins and the aqueous solution free of oxalic acid can be concentrated to give a commercial 50% strength by weight glyoxylic acid. If the mode of operation is continuous, the glyoxylic acid is continuously extracted from the reaction mixture according to conventional methods, and the corresponding equivalent proportion of fresh oxalic acid is fed in simultaneously.

The reaction by-products, especially glycolic acid, acetic acid and formic acid, are not separated, or not completely separated, from the glyoxylic acid according to these methods. It is therefore important to achieve high selectivity in the process, in order to avoid laborious purification processes. The process according to the invention is notable in that the proportion of the sum of by-products can be kept very low. It is between 0 and 5 mol %, preferably below 3 mol %, especially below 2 mol %, relative to the glyoxylic acid.

The selectivity of the process according to the invention is all the more notable in that-even if the final concentration of oxalic acid is low, i.e. of the order of 0.2 mol of oxalic acid per liter of electrolysis solution, the proportion of by-products is preferably below 3 mol %, based on glyoxylicacid.

A further advantage of the process according to the invention is the long-term stability of the cathodes employed, compared to the conventional lead cathodes.

In the following examples which describe the present invention in greater detail a divided forced-circulation cell is used which is constructed as follows:

Forced-circulation cell with an electrode area of 0.02 m$^2$ and an electrode gap of 3 mm.

| | |
|---|---|
| A) Cathode: | Alloy steel, Material No. 1.4571 (according to DIN 17440), unless otherwise specified. |
| Anode: | dimensionally stable anode for generating oxygen on the basis of iridium oxide on titanium |
| Cation exchanger membrane: | 2-layer membrane made of copolymers from perfluorosulfonylethoxyvinyl ether + tetrafluoroethylene. On the cathode side there is a layer having the equivalent weight 1300, on the anode side there is one having the equivalent weight 1100, for example ® Nafion 324 from DuPont; |
| Spacers: | Polyethylene netting |

The quantitative analysis of the components was carried out by means of HPLC, the chemical yield is defined as the amount of glyoxylic acid produced based on the amount of oxalic acid consumed. The current yield is based on the amount of glyoxylic acid produced. The selectivity has already been defined above.

EXAMPLE 1

(comparative example) without the addition of salt

Electrolysis conditions:

| | |
|---|---|
| Current density: | 2500 A/m$^2$ |
| Cell voltage: | 4–6 V |
| Catholyte temperature: | 16° C. |
| Catholyte flow rate: | 400 l/h |
| Anolyte: | 2N sulfuric acid |

Starting catholyte:

2418 g (19.2 mol) of oxalic acid dihydrate in 24 1 of aqueous solution.

After the electrolysis had proceeded for 5 minutes, the current yield for the formation of hydrogen was determined as 84%, but virtually no glyoxylic acid was being formed.

EXAMPLE 2

Electrolysis conditions and starting catholyte as in Example 1.

However 1.76 g of lead(II) acetate trihydrate were added to the catholyte. After the electrolysis had proceeded for 5 minutes, the current yield for hydrogen was determined as 6%. After a charge of 945 Ah had been transferred, the catholyte was drained into a holding tank and analyzed:

| | | |
|---|---|---|
| Total volume 25.4 1 | | |
| 0.21 mol/l | Oxalic acid | (5.33 mol) |
| 0.54 mol/l | Glyoxylic acid | (13.7 mol) |
| 0.0015 mol/l | Glycolic acid | (0.04 mol) |
| 0.0004 mol/l | Formic acid | (0.01 mol) |
| 0.0004 mol/l | Acetic acid | (0.01 mol) |
| Chemical yield of glyoxylic acid | | 99% |
| Current yield | | 78% |
| Selectivity | | 99.6% |

EXAMPLE 3

Follow-up experiment to Example 2

Electrolysis conditions as in Example 2

Starting catholyte:

2418 g (19.2 mol) of oxalic acid dihydrate in 24 1 of aqueous solution with the addition of 0.088 g of lead(II) acetate dihydrate and 2.6 ml of 65% strength nitric acid.

After a charge of 945 Ah had been transferred, a sample was taken and the current yield for glyoxylic acid was found to be 80%. After a charge of 1045 Ah had been transferred, the catholyte was drained and analyzed.

| | | |
|---|---|---|
| Total volume: 25.3 1 | | |
| 0.17 mol/l | Oxalic acid | (4.30 mol) |
| 0.58 mol/l | Glyoxylic acid | (14.7 mol) |
| 0.0024 mol/l | Glycolic acid | (0.06 mol) |
| Chemical yield of glyoxylic acid | | 99% |
| Current yield | | 76% |
| Selectivity | | 99.6%. |

EXAMPLE 4

Electrolysis conditions-as in Example 1

Starting catholyte:

403 g (3.2 mol) of oxalic acid dihydrate in 4000 ml of aqueous solution, addition of 1.46 g of lead(II) acetate trihydrate. After a charge of 171 Ah had been transferred, the catholyte was drained and analyzed.

| | | |
|---|---|---|
| Final catholyte: | Total Volume | 4270 ml |
| | 0.15 mol/l | Oxalic acid |
| | 0.57 mol/l | Glyoxylic acid |
| | 0.0038 mol/l | Glycolic acid |
| | 0.0004 mol/l | Formic acid |
| | 0.0019 mol/l | Acetic acid |
| Chemical yield: | 95% | |
| Current yield: | 76% | |
| Selectivity: | 98.9%. | |

EXAMPLE 5

Follow-up experiment to the electrolysis according to Example 4

Electrolysis conditions as in Example 1.

Starting catholyte:

403 g (3.2 mol) of oxalic acid dihydrate in 4000 ml of aqueous solution, addition of 30 mg of lead(II) acetate dihydrate.

After passage of 171 Ah each time, the catholyte was drained into a holding tank, 270 ml of water was added to the anolyte, and a fresh starting catholyte solution was fed in. After a total of 684 Ah, the collected catholyte solution was analyzed.

| | | |
|---|---|---|
| Final catholyte: | Total Volume | 17.1 1 |
| | 0.13 mol/l | Oxalic acid |
| | 0.55 mol/l | Glyoxylic acid |
| | 0.0056 mol/l | Glycolic acid |
| | 0.0006 mol/l | Formic acid |
| | 0.0002 mol/l | Acetic acid |
| Chemical yield: | 89% | |
| Current yield: | 73% | |
| Selectivity: | 98.8%. | |

EXAMPLE 6

As Example 4, but employing an alloy steel cathode having the material No. 1.4541 (according to DIN 17 440).

| | | |
|---|---|---|
| Final catholyte: | Total Volume | 4270 ml |
| | 0.19 mol/l | Oxalic acid |
| | 0.52 mol/l | Glyoxylic acid |
| | 0.0027 mol/l | Glycolic acid |
| | 0.0012 mol/l | Acetic acid |
| Chemical yield: | 93% | |
| Current yield: | 70% | |
| Selectivity: | 99.3%. | |

EXAMPLE 7

As Example 4, but employing a copper cathode with the code designation SF-CuF20 (according to DIN 17 670) having a minimum copper content of 99.9%.

| | | |
|---|---|---|
| Final catholyte: | Total Volume | 4260 ml |
| | 0.17 mol/l | Oxalic acid |
| | 0.55 mol/l | Glyoxylic acid |
| | 0/0073 mol/l | Glycolic acid |
| | 0.0026 mol/l | Acetic acid |
| Chemical yield: | 95% | |
| Current yield: | 73% | |
| Selectivity: | 98.2%. | |

| | | |
|---|---|---|
| B) | Cathode: | Material graphite, for example ® Diabon N from Sigri, Meitingen |
| | Anode: | dimensionally stable anode for generating oxygen on the basis of iridium oxide on titanium |
| | Cation exchanger membrane: | 2-layer membrane made of copolymers from perfluoro-sulfonylethoxyvinyl ether + tetrafluoroethylene. On the cathode side there is a layer having the equivalent weight 1300, on the anode side there is one having the equivalent weight 1100, for example ® Nafion 324 from DuPont; |
| | Spacers: | Polyethylene netting |

The quantitative analysis of the components was carried out by means of HPLC, the chemical yield is defined as the amount of glyoxylic acid produced based on the amount of oxalic acid consumed. The current yield is based on the amount of glyoxylic acid produced. The selectivity has already been defined above.

EXAMPLE 1

Electrolysis conditions

| | |
|---|---|
| Current density: | 2500 A $m^{-2}$ |
| Cell voltage: | 5.1–6.5 V |
| Catholyte temperature: | 16° C. |
| Catholyte flow rate: | 300 l/h |
| Anolyte: | 2N sulfuric acid |
| Starting catholyte: | 101 g of oxalic acid dehydrate (0.8 mol) in 1010 ml of aqueous solution; addition of 360 mg of lead(II) acetate trihydrate (200 ppm of $Pb^{2+}$) |
| Final catholyte: | Total volume 1080 ml; 0.16 mol/l oxalic acid (0.17 mol); |

-continued

| | |
|---|---|
| | 0.57 mol/l glyoxylic acid (0.61 mol); 0.0085 mol/l glycolic acid (0.009 mol); 0.0028 mol/l acetic acid (0.003 mol). |
| Chemical yield of glyoxylic acid: | 97% |
| Current consumption: | 43 Ah |
| Current yield: | 76% |
| Selectivity: | 98.1% |

EXAMPLE 2

The same procedure was followed as in Example 1 except that no lead salt was added but instead the electrolytic cell, between the electrolyses, was kept under protective current and the catholyte was kept under inert gas. The immediately preceding electrolysis was the electrolysis carried out in accordance with Example 1. Electrolysis conditions

| | |
|---|---|
| Current density: | 2500 $Am^{-2}$ |
| Cell voltage: | 5.1–7.1 V |
| Catholyte temperature: | 16° C. |
| Catholyte flow rate: | 300 l/h |
| Anolyte: | 2N sulfuric acid |
| Starting catholyte: | 101 g of oxalic acid dihydrate (0.8 mol) in 1000 ml of aqueous solution; |
| Final catholyte: | Total volume 1050 ml; 0.15 mol/l oxalic acid (0.16 mol); 0.60 mol/l glyoxylic acid (0.63 mol); 0.0086 mol/l glycolic acid (0.009 mol); no further by-products could be detected. |
| Chemical yield of glyoxylic acid: | 98% |
| Current consumption: | 43 Ah |
| Current yield: | 79% |
| Selectivity: | 98.6% |

EXAMPLE 3

Follow-up experiment to electrolysis according to Example 2

Electrolysis conditions

| | |
|---|---|
| Current density: | 2500 $Am^{-2}$ |
| Cell voltage: | between 5 and 7 V |
| Catholyte temperature: | 16° C. |
| Catholyte flow rate: | 300 l/h |
| Anolyte: | 2N sulfuric acid |
| Starting catholyte: | 101 g of oxalic acid dihydrate (0.8 mol) in 1010 ml of aqueous solution, addition of 7.2 mg of lead(II) acetate trihydrate (4 ppm of $Pb^{2+}$). After passage of 43 Ah a sample was taken for analysis each time, the catholyte was drained into a holding tank, 70 ml of water were added to the anolyte, and a fresh starting catholyte solution was fed in. After a total of 946 Ah, the collected catholyte solution was analyzed. |
| Final catholyte: | Total volume 23.5 l; 0.19 mol/l oxalic acid (4.47 mol); 0.54 mol/l glyoxylic acid (12.7 mol); 0.0043 mol/l glycolic acid (0.10 mol); 0.0021 mol/l formic acid (0.05 mol). |
| Chemical yield of glyoxylic acid: | 97% |
| Current consumption: | 946 Ah |

-continued

| | |
|---|---|
| Current yield: | 72% |

The current yield remains constant over the entire experiment within the range of random fluctuations.

| | |
|---|---|
| Selectivity: | 98.8% |

EXAMPLE 4

Electrolysis conditions

| | |
|---|---|
| Current density: | 2500 $Am^{-2}$ |
| Cell voltage: | 5.1–6.0 V |
| Catholyte temperature: | 16° C. |
| Catholyte flow rate: | 400 l/h |
| Anolyte: | 2N sulfuric acid |
| Starting catholyte: | 2418 g of oxalic acid dehydrate (19.2 mol) in 24 l of aqueous solution, addition of 1.76 g of lead(II) acetate trihydrate (40 ppm of $Pb^{2+}$) |
| Final catholyte: | Total volume 25.2 l; 0.20 mol/l oxalic acid (5.04 mol); 0.53 mol/l glyoxylic acid (13.4 mol); 0.0036 mol/l glycolic acid (0.089 mol); 0.0003 mol/l formic acid (0.008 mol); 0.0006 mol/l acetic acid (0.015 mol). |
| Chemical yield of glyoxylic acid: | 95% |
| Current consumption: | 945 Ah |
| Current yield: | 76% |
| Selectivity: | 99.2% |

EXAMPLE 5

Electrolysis conditions

| | |
|---|---|
| Current density: | 2500 $Am^{-2}$ |
| Cell voltage: | 5–7 V |
| Catholyte temperature: | 16° C. |
| Catholyte flow rate: | 400 l/h |
| Anolyte: | 2N sulfuric acid |

Starting catholyte:

a) 302 g (2.4 mol) of oxalic acid dihydrate in 3000 ml of water, addition of 1.08 g of lead(II) acetate trihydrate (200 ppm of $Pb^{2+}$)

b) After the passage of 128 Ah, the catholyte was drained and analyzed, 200 ml of water were added to the anolyte and a fresh catholyte solution was fed in which contained 302 g (2.4 mol) of oxalic acid dihydrate in 3000 ml of water, addition of 21 mg of lead(II) acetate trihydrate (4 ppm of $Pb^{2}$+).

c) After the passage of a further 128 Ah, the same procedure was followed as under b), followed by further electrolysis. This time, however, a further 2.4 mol of oxalic acid in solid form were additionally dosed in while the electrolysis proceeded, and twice the charge, corresponding to 257 Ah, was transferred.

The results are recorded in the following table:

| | a) | b) | c) |
|---|---|---|---|
| Oxalic acid used: | 2.4 mol | 2.4 mol | 4.8 mol |
| Charge transferred: | 128 Ah | 128 Ah | 257 Ah |
| Final catholyte: | | | |
| Total volume | 3.2 | 3.2 | 3.4 |
| Oxalic acid | 0.11 mol/l | 0.11 mol/l | 0.13 mol/l |
| Glyoxylic acid | 0.60 mol/l | 0.62 mol/l | 1.02 mol/l |
| Glycolic acid | 0.0024 mol/l | 0.0069 mol/l | 0.013 mol/l |
| Formic acid | — | — | 0.002 mol/l |
| Acetic acid | 0.0024 mol/l | 0.0025 mol/l | 0.0031 mol/l |
| Chemical yield | 94% | 97% | 80% |
| Current yield | 80% | 83% | 72% |
| Selectivity | 99.2% | 98.5% | 98.2% |

This example demonstrates how a high glyoxylic acid concentration is reached at the same time as a low oxalic acid concentration, while the high selectivity is retained.

EXAMPLE 6

Long-term stability

Follow-up experiment to Example 4, electrolysis conditions as for Example 4

The electrolysis duration was 10395 Ah without intermediate treatment of the electrochemical cell.

Starting catholyte:

2418 g (19.2 mol) of oxalic acid dihydrate in 24 l of water, and additions of 22 mg of lead(II) acetate trihydrate (0.5 ppm of $Pb^{2+}$) and 0.86 ml of 65% strength $HNO_3$ (33 ppm of $HNO_3$). Each time a charge of 945 Ah had been transferred, a sample was taken to determine the current yield, the catholyte was drained into a holding tank, 1200 ml of water were added to the anolyte, and a fresh catholyte solution corresponding to the starting catholyte was fed in. After a total of 10395 Ah (208 h electrolysis duration) the collected catholytes were analyzed.

| | |
|---|---|
| Final catholyte: | Total volume 277 l;<br>0.24 mol/l oxalic acid (66.5 mol);<br>0.50 mol/l glyoxylic acid (139 mol);<br>0.0038 mol/l glycolic acid (1.1 mol);<br>0.0012 mol/l formic acid (0.33 mol); |
| Chemical yield | 96% |
| Current yield | 72% |
| Selectivity | 99.0% |

The course of the current yield after every 945 Ah was constant at (72±6) % within the range of random fluctuations. Within the duration of the experiment, no trend towards increased or reduced current yield could be detected.

EXAMPLE 7

Follow-up experiment to Example 6

Electrolysis conditions as in Examples 4 and 6

Starting catholyte as in Example 6.

After the passage of 945 Ah (corresponding to 92% of the theoretical charge) and after 1040 Ah (corresponding to 101% of the theoretical charge), samples were analyzed.

| Final catholyte: after transferred charge of | 945 Ah | 1040 Ah |
|---|---|---|
| Total volume | 25.2 | 25.3 |
| Oxalic acid | 0.22 mol/l | 0.18 mol/l |
| Glyoxylic acid | 0.50 mol/l | 0.53 mol/l |
| Glycolic acid | 0.0037 mol/l | 0.0047 mol/l |
| Formic acid | 0.0035 mol/l | 0.0037 mol/l |
| Acetic acid | 0 | 0.0003 mol/l |
| Chemical yield | 93% | 91% |
| Current yield | 71% | 69% |
| Selectivity | 98.6% | 98.4% |

The example illustrates that, for an oxalic acid concentration below 0.2 mol/l the high selectivity is retained. Chemical yield and current yield are somewhat lower than for higher oxalic acid concentrations.

EXAMPLE 8

Catalytic effect of added metal salts

Prior to each experiment, the cathode was rinsed with 10% strength nitric acid for at least 30 minutes at approximately 25° C. Electrolysis conditions as for Example 5.

During the experiment, the amount of hydrogen generated at the cathode was measured.

Starting catholyte:

302 g (2.4 mol) of oxalic acid dihydrate in 3000 ml of water a) without further addition, b) with 1.08 g of lead(II) acetate trihydrate, c) with 1.25 g of zinc chloride, d) with 1.39 g of bismuth(III) nitrate pentahydrate and e) with 1.51 g of copper(II) sulfate pentahydrate.

After the passage of 128 Ah (corresponding to 100% of the charge to be transferred theoretically), the amount of hydrogen generated at the cathode was as follows: a) 26 1, b) 5.5 1, c) 12 1, d) 6.11, e) 19 1.

The example shows that the side reaction of cathodic generation of hydrogen is inhibited when the metal salts are dosed in.

We claim:

1. An electrolysis process for preparing glyoxylic acid by electrochemical reduction of oxalic acid at a cathode in aqueous solution in divided or undivided electroyltic cells, said cathode comprising carbon or at least 50% by weight of at least one of the metals selected from the group consisting of Cu, Ti, Zr, V, Nb, Ta, Fe, Co, Ni, Sn, Zn, Al and Cr and the aqueous electorlysis solution in a said undivided cell or in the cathode compartment of a said divided cell in addition contains at least one salt of a metal having a hydrogen overpotential of at least 0.25 V, based on a current density of 2500 A/m$^2$ and which salt, in the case of a carbon cathode, has a minimum concentration of $10^{-6}$% by weight in the aqueous electrolysis solution.

2. The process as claimed in claim 1, wherein the cathode comprises at least 50% by weight of at least one of the metals selected from the group consisting of Fe, Co, Ni, Cr, Cu, and Ti.

3. The process as claimed in claim 1, wherein the cathode comprises at least 50% by weight of an alloy of two or more of the metals selected from the group consisting of Cu, Ti, Zr, V, Nb, Ta, Fe, Co, Ni, Sn, Zn, Al and Cr.

4. The process as claimed in claim 2, wherein the cathode comprise at least 80% by weight of an alloy of two or more of the metals selected from the group consisting of Fe, Co, Ni, Cr, Cu and Ti.

5. The process as claimed in claim 1, wherein the cathode comprises at least 80% by weight of an alloy of two or more of the metals mentioned in claim 1, and from 0 to 20% by weight of any other metal and from 0 to 3% by weight of a nonmetal.

6. The process as claimed in claim 1, wherein the cathode comprises alloy steel.

7. A process as claimed in claim 6, wherein the alloy steel comprises a stainless chromium-nickel steel.

8. The process as claimed in claim 1, wherein the cathode comprises graphite.

9. The process as claimed in claim 1, wherein the concentration of a said salt or a metal having a hydrogen overpotential of at least 0.25 V, based on a current density of 2500 $A/m^2$, in the aqueous electrolysis solution in the undivided cell or in the cathode compartment of the divided cell is from $10^{-7}$ to 10% by weight.

10. The process as claimed in claim 8, wherein the concentration of a said salt of a metal having a hydrogen overpotential of at least 0.25 V, based on a current density of 2500 $A/m^2$, in the aqueous electrolysis solution in the undivided cell or in the cathode compartment of the divided cell is from $10^{-6}$ to 10% by weight.

11. The process as claimed in claim 1, wherein a said salt of a metal having a hydrogen overpotential of at least 0.25 V, based on a current density of 2500 $A/m^2$, is a salt of Cu, Ag, Au, Zn, Cd, Fe, Hg, Sn, Pb, Tl, Ti, Zr, Bi, V, Ta, Cr, Ce, Co, or Ni.

12. The process as claimed in claim 2, wherein the current density is between 10 and 10,000 $A/m^2$.

13. The process as claimed in claim 8, wherein the current density is between 10 and 5000 $A/m^2$.

14. The process as claimed in claim 1, wherein the electrolysis process is carried out at a temperature between −20° C. and +40° C.

15. The process as claimed in claim 1, wherein the oxalic acid concentration in the electrolysis solution ranges from 0.1 mol per liter of electrolysis solution up to the saturation concentration of oxalic acid in the electrolysis solution at an electrolysis process temperature between −20° C. and +40° C.

16. The process as claimed in claim 1, wherein the aqueous electrolysis solution contains from $10^{-7}$ to 10% by weight of a mineral acid or organic acid.

17. The process as claimed in claim 1, wherein the electrolysis process is carried out in divided electrolytic cells.

18. The process as claimed in claim 17, wherein the division of the cell into a cathode compartment and an anode compartment is provided by means of a cation exchange membrane comprising polymers containing carboxylic acid groups or sulfonic acid groups or both.

19. The process as claimed in claim 2, wherein the cathode comprises at least 80% by weight of an alloy of two or more of the metals mentioned in claim 2, and from 0 to 30% by weight of any other metal and from 0 to 3% by weight of a nonmetal.

20. The process as claimed in claim 2, wherein the cathode comprise at least 93% by weight of an alloy of two or more metals selected from the group consisting of Fe, Co, Ni, Cr, Cu and Ti and from 4 to 7% by weight of Mn, Ti, Mo or a combination thereof, and a non-metal selected from the group consisting of C, Si, P, S and a combination thereof, in an amount of not more than 1.2% by weight.

21. The process as claimed in claim 10, wherein the aqueous electrolysis solution in the undivided cell or cathode compartment of the undivided cell is from $10^{-4}$ to $4\times10^{-2}$ by weight and the current density is between 100 and 4,000 $A/m^2$ and the electrolysis process is carried out at a temperature between +10° C. and +18° C.

* * * * *